United States Patent [19]

Wenstrup

[11] Patent Number: 4,472,117

[45] Date of Patent: Sep. 18, 1984

[54] INFUSION PUMPING APPARATUS

[75] Inventor: Jan F. Wenstrup, Doylestown, Pa.

[73] Assignee: Air-Shields, Inc., Hatboro, Pa.

[21] Appl. No.: 353,085

[22] Filed: Mar. 1, 1982

[51] Int. Cl.[3] ..... F04B 43/12

[52] U.S. Cl. ..... 417/477

[58] Field of Search ..... 417/360, 475–477; 604/153

[56] References Cited

U.S. PATENT DOCUMENTS 3,567,345 3/1971 Ballentine ..... 417/477
3,873,242 3/1975 Anderson ..... 417/360
4,132,509 1/1979 Bongartz et al. ..... 417/475
4,211,519 7/1980 Hogan ..... 417/360

*Primary Examiner*—Richard E. Gluck
*Attorney, Agent, or Firm*—Weiser, Stapler & Kimmelman

[57] ABSTRACT

Infusion pumping apparatus having means for releasing back pressures which can develop in an infusion tube (18) through which fluid is being driven. When an excessive back pressure is developed, the infusion tube expands into a peripheral groove (43) on a drive roller (38) carried at the periphery of a rotor body (20).

18 Claims, 5 Drawing Figures

INFUSION PUMPING APPARATUS

DESCRIPTION

1. Technical Field

The present invention relates, in general, to pumps and, in particular, to pumping apparatus for the infusion of fluids into the body. As used herein, the term infusion applies both to the introduction of supplementary fluids, such as intravenous medication, intravenous feeding and blood transfusions, and returning body fluids, such as by dialysis and extracorporeal blood circulation.

2. Background Art

The infusion of fluids into the body is accomplished commonly by means of a pump acting upon a tube which carries the fluid. In the case of a rotary pump, the pump rotor carries a number of rollers at its periphery which repetitively compress the tube, thereby infusing metered amounts of fluid into the body. The rate of fluid flow through the tube is dependent upon the tube diameter and the rotation rate of the pump rotor and the diameters of the rotor and rollers. Such an arrangement is particularly desirable in that the fluid flow may be controlled quite accurately and the system, being closed, prevents leakage and contamination.

In the past, infusion pumps have been arranged with the pump rotor mounted permanently to the other pump components or in a cassette with the rotor adapted to engage the output shaft of the pump motor when the cassette is inserted into its housing. The cassette arrangement has certain advantages. The rotor tends to collect dirt and the components which contact the tube tend to wear. Cleaning and repair of the rotor is much easier if it can be removed, as when mounted in a removable cassette.

Whether the rotor is permanently mounted to the other pump components or arranged in a cassette, an infusion pump should be arranged to sense and relieve excessive head pressures which can develop in the tube due to occlusions because such pressure can cause serious problems. For example, infusion tubes normally are arranged with a filter to prevent contaminants from entering the body. Excessive fluid pressure in the tube can destroy such a filter, thereby permitting contaminants to enter the body. Also, excessive pressure in the tube can cause the tube to rupture. Yet another problem can occur when the occlusion is released and the fluid rushes into the body at an excessively high rate because the pressure is released.

A common approach to solving the problem of excessive pressure build up in the infusion tube is to mount the tube engaging components so that they may move away from the tube when an excessive pressure is detected. For example, rollers have been spring mounted on pump rotors, thereby allowing the rollers to back away from the tube. Although the rotor continues to rotate, the rollers no longer compress the tube and no additional fluid is pumped through the tube. Pumps arranged this way tend to be undesirable in that they involve extra components which are joined together in an unduly complex manner. Besides adding to the cost of the infusion pump, they are likely to require more frequent and expensive maintenance than a simpler arrangement.

DISCLOSURE OF THE INVENTION

Accordingly, it is an object of the present invention to provide new and improved infusion pumping apparatus.

It is another object of the present invention to provide a pump which is arranged to relieve back pressures developed in an infusion tube through which the pump forces fluid.

It is yet another object of the present invention to provide a rotor for an infusion pump which is arranged to sense excessive pressures in a tube through which fluid is being forced by the pump and to discontinue forcing additional fluid through the tube when such excessive pressures are sensed.

It is a further object of the present invention to provide such a pump rotor in a cassette which is detachable from the remaining pump components.

It is yet another object of the present invention to provide infusion pumping apparatus which is simple in construction, reliable in operation, easy to maintain and relatively inexpensive to fabricate.

Infusion pumping apparatus, constructed in accordance with the present invention, includes a housing for containing an infusion tube and drive means within the housing for repetitively compressing the tube to drive selected amounts of fluid through the tube. A working surface either in the housing or the drive means is arranged with a relief into which the tube expands upon development of a predetermined pressure within the tube. The relief is positioned inward of the edges of the infusion tube when compressed. The present invention may be incorporated in a rotating pump having rollers carried at the periphery of the pump rotor by providing peripheral grooves in the rollers which extend around the circumference of the rollers.

Another aspect of the present invention is the incorporation of such a pump rotor in a cassette. The cassette includes a housing having a rotor cavity and inlet and outlet passages extending through the housing from the outside surface of the housing to two spaced points in the rotor cavity. The inlet and outlet passages are adapted to contain an infusion tube which runs through the two passages and the rotor cavity. The rotor body is mounted for rotation within the rotor cavity, whereby the rotor rollers engage the tube to repetitively compress the tube and drive selected amounts of fluid through the tube.

BRIEF DESCRIPTION OF THE DRAWING

Referring to the drawing.

BEST MODE OF CARRYING OUT THE INVENTION

Figure 1:
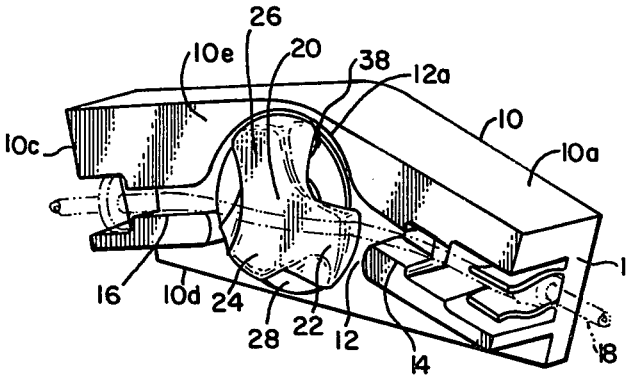
FIG. 1 is a perspective view of a rotor cassette constructed in accordance with the present invention.

Referring to the drawing, a rotor cassette, constructed in accordance with the present invention, includes a housing 10 having a rotor cavity 12 formed with a curved working surface 12*a*. As shown, working surface 12*a* is a portion of a cylinder. Housing 10 has a top edge 10*a*, two side edges 10*b* and 10*c*, a bottom edge 10*d*, a front surface 10*e*, and a back surface 10*f*. Rotor cavity 12 is formed as a recess in front surface 10*e* as are an inlet passage 14 and an outlet passage 16 which extend through housing 10 from side edges 10*b* and 10*c*, respectively, to two spaced points on curved working surface 12*a* of the rotor cavity. Inlet passage 14 and outlet passage 16 are adapted to contain an infusion tube 18 shown in phantom in FIGS. 1, 2, and 4 and in solid in FIGS. 3 and 5. Tube 18 preferably is made from a suitable silicone material. When properly loaded, tube 18 extends from inlet passage 14 to outlet passage 16 through rotor cavity 12 along curved working surface 12*a*. As shown most clearly in FIG. 2, inlet passage 14 and outlet passage 16 enter rotor cavity 12 at points approximately 180° apart.

A rotor cassette, constructed in accordance with the present invention, also includes a rotor body 20 mounted for rotation within rotor cavity 12. Rotor 20 has a plurality of fingers 22, 24 and 26 located at three equally spaced angular positions.

Rotor body 20 also includes an inner wall 28 spaced axially from rotor fingers 22, 24 and 26. Wall 28 and fingers 22, 24 and 26 extend radially outward from a hub 30 of the rotor body to form three angularly spaced yokes. The relationship between inner wall 28 and the rotor fingers is shown most clearly in FIG. 3.

Rotor body 20 is mounted for rotation within cavity 12 with its axis of rotation coinciding with the axis of cylindrical working surface 12*a*. Rotor body 20 is mounted by means of an axial extension 32 of hub 30 which is fitted within a circular bore 34 extending from a rear wall 12*b* of cavity 12 to a recessed portion of back surface 10*f* of housing 10. Extension 32 of hub 30 has a peripheral groove 35 which projects beyond the back surface of the housing and receives a retaining ring 36 for restraining axial movement of the rotor body. In this manner, inner wall 28 of rotor body 20 is located adjacent rear wall 12*b* of cavity 12 and serves as a bearing surface for the rotor body as it is positioned within the rotor cavity.

Figure 3:
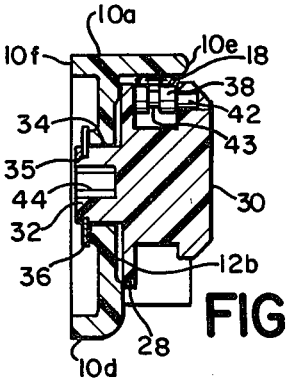
FIG. 3 is a sectional view taken along lines 3—3 of FIG. 2.
Figure 4:
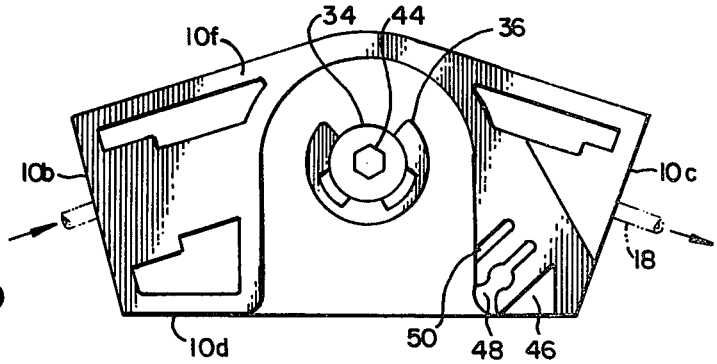
FIG. 4 is a rear view of the FIG. 1 cassette.
Figure 5:
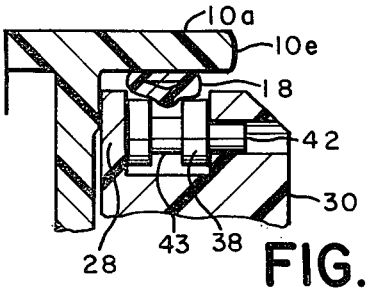
FIG. 5 is an enlarged sectional view of a portion of FIG. 3.

A rotor cassette, constructed in accordance with the present invention, further includes a plurality of rollers mounted at the periphery of rotor body 20 for rotation about axes parallel to the rotation axis of the rotor body. One such roller is associated with each rotor finger. In the various views of the drawing, only one roller 38, associated with finger 26 is shown. Each roller is mounted in the yoke formed by inner wall 28 and the associated finger by means of a pin 42 which extends between the rotor finger and inner wall 28. The rollers are mounted to be spaced from curved working surface 12*a* so that the rollers squeeze tube 18 running along the working surface between the rollers and the working surface. As shown in FIGS. 3 and 5, each roller has a peripheral groove 43 extending around the circumference of the roller.

In order to impart rotary movement to rotor body 20, an axial bore 44 is provided in hub 30 of the rotor body. This bore, hexagonal in cross-section for the embodiment of the invention illustrated, is adapted to receive the output shaft of a drive motor when the cassette is inserted into its housing.

The back surface of housing 10 has three cutouts 46, 48 and 50 which function to lock the cassette in place when it is inserted into its housing. Cutouts 46 and 50 provide relief so that cutout 48 may flex to receive a slightly oversized pin or stud secured to the cassette housing.

Figure 2:
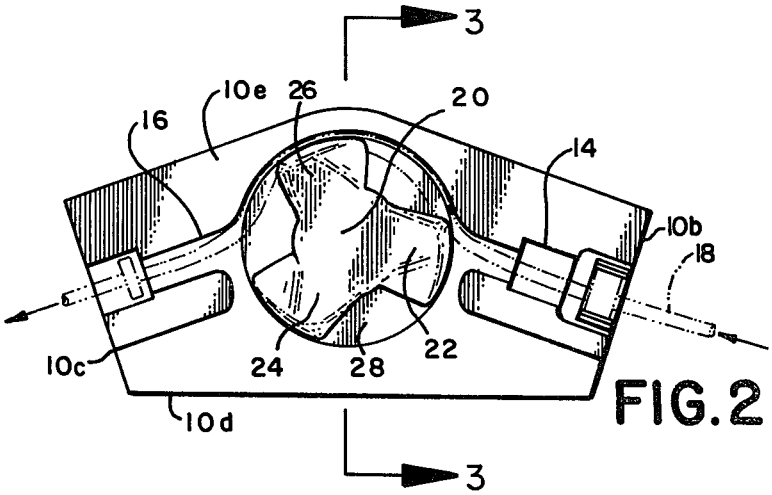
FIG. 2 is a front view of the FIG. 1 cassette.

In operation, the cassette is inserted into its housing with bore 44 receiving the output shaft of the drive motor and cutout 48 receiving the locking pin. After the cassette is in place, infusion tube 18 is snapped into inlet passage 14 and outlet passage 16 with a section of the tube extending across the outside surface of rotor body 20 as shown in FIG. 1. The fitting of tube 18 within passages 14 and 16 and the lubricity of the outside surface of the tube is such that the tube may slide within the passages. Next, the pump motor is turned on and rotor body 20 rotates. As rotor body 20 rotates, the rotor fingers engage tube 18 at the point at which inlet passage 14 enters rotor cavity 12. The shapes of the fingers are such that upon impact of the fingers with the tube, the tube is drawn into the rotor cavity from the position shown in FIG. 1 to the position shown in FIGS. 2, 3 and 5. The smooth contact surfaces of the rotor fingers spread the impact of the fingers on the tube and prevent damage of the tube. Once the tube is loaded and rotor body 20 continues to rotate, the rollers repetitively squeeze the tube as shown in FIG. 3 to drive infusion fluid through the tube in selected amounts determined by the tube diameter, the rotation rate of the rotor body, and the diameters of the rotor body and rollers.

Groove 43 in each roller serves to relieve back pressures which build up in tube 18 due to occlusions. The characteristics of tube 18 are such that as infusion fluid in the tube backs up, the tube is able to expand into groove 43 of the rollers as the rollers engage the tube. As a result, instead of squeezing tube 18 closed as shown in FIG. 3, the grooved roller permits the bore of the tube 18 to remain open preventing the rollers from forcing additional fluid through the tube. Although groove 43 is shown as having a rectangular cross-section, other shapes may be used. Also, it should be noted that a pressure release groove may be cut into working surface 12*a* instead of using grooved rollers.

The present invention has been described in connection with a rotary pump. It will be apparent that the present invention may be incorporated in other types of infusion pumps, such as those which are arranged to engage the infusion tube linearly.

While in the foregoing there has been described a preferred embodiment of the present invention, it should be understood to those skilled in the art that various modifications and changes can be made without departing from the true spirit and scope of the invention as recited in the claims.

What is claimed is:

1. Infusion pumping apparatus comprising:

an infusion tube for conducting infusion fluid;

and a rotor cassette for pumping infusion fluid through said infusion tube by repetitively compressing said infusion tube, said cassette having:

(a) a housing having a rotor cavity and inlet and outlet passages extending through said housing from the outside surface of said housing to two spaced points in said rotor cavity, said rotor cavity and said inlet and outlet passages containing said infusion tube;

(b) a rotor body mounted for rotation within said rotor cavity; and (c) a plurality of rollers mounted at the periphery of said rotor body for rotation about axes parallel to the rotation axis of said rotor body, said rollers positioned and sized to compress said infusion tube, each roller having a peripheral groove extending around the circumference of said roller and positioned inward of the edges of said infusion tube when compressed.

2. Infusion pumping apparatus according to claim 1 wherein the rotor cavity and the inlet and outlet passages are recesses in the outside surface of the housing.

3. Infusion pumping apparatus according to claim 2 wherein the rotor cavity has a curved working surface which is a portion of a cylinder having an axis which coincides with the rotation axis of the rotor body.

4. Infusion pumping apparatus according to claim 3 wherein the housing has a circular bore extending along the rotation axis of the rotor body from the outside surface of said housing to the rotor cavity and said rotor body has an axial hub fitted within said circular bore to mount said rotor body for rotation within said rotor cavity.

5. Infusion pumping apparatus according to claim 4 wherein the rotor body has an axial bore extending through the hub and adapted to receive an output shaft of a motor.

6. Infusion pumping apparatus according to claim 5 further including means engaging the rotor body for restraining said rotor body against axial movement.

7. Infusion pumping apparatus according to claim 6 wherein the axial hub projects beyond the outside surface of the housing and the restraining means include a retaining ring fitted within a peripheral groove in said axial hub outside said housing.

8. Infusion pumping apparatus according to claim 7 wherein the inlet and outlet passages open into the rotor cavity at opposite sides of said rotor cavity.

9. Infusion pumping apparatus according to claim 1 wherein the rollers are mounted at equally spaced angular positions.

10. Infusion pumping apparatus according to claim 9 wherein the rotor body includes a plurality of radially extending fingers and a radially extending wall spaced axially from said fingers.

11. Infusion pumping apparatus according to claim 10 further including a plurality of pins, one for each roller, extending between the radially extending fingers and the radially extending wall and upon which said rollers are mounted.

12. Infusion pumping apparatus according to claim 1 wherein the peripheral grooves on the rollers have a rectangular cross-section.

13. Infusion pumping apparatus comprising:

an infusion tube for conducting infusion fluid;

a housing for containing said infusion tube;

and drive means within said housing for repetitively compressing said tube to drive selected amounts of fluid through said tube;

said housing and said drive means having spaced working surfaces between which said tube is positioned and one of said working surfaces having a relief into which said tube expands upon development of a predetermined pressure within said tube, said relief positioned inward of the edges of said infusion tube when compressed.

14. Infusion pumping apparatus according to claim 13 wherein the relief is a groove.

15. Infusion pumping apparatus according to claim 14 wherein the groove is in the working surface of the drive means.

16. Infusion pumping apparatus according to claim 13 wherein the drive means include a plurality of rollers and the relief is a peripheral groove extending around the circumference of each roller.

17. Infusion pumping apparatus according to claim 16 wherein the drive means include a rotor and the rollers are mounted at the periphery of said rotor for rotation about axes parallel to the rotation axis of said rotor.

18. Infusion pumping apparatus according to claim 17 wherein the rollers are mounted at equally spaced angular positions.

* * * * *